US007762654B2

(12) United States Patent
Kawamura et al.

(10) Patent No.: US 7,762,654 B2
(45) Date of Patent: Jul. 27, 2010

(54) LIQUID CONTAINER

(75) Inventors: Shogo Kawamura, Namazu (JP); Yasuo Kotani, Yokohama (JP); Hideki Ogura, Yokohama (JP); Ryoji Inoue, Kawasaki (JP); Tetsuya Ohashi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 686 days.

(21) Appl. No.: 11/468,245

(22) Filed: Aug. 29, 2006

(65) Prior Publication Data

US 2007/0052772 A1 Mar. 8, 2007

(30) Foreign Application Priority Data

Sep. 2, 2005 (JP) ..... 2005-255092

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 6,000,790 A 12/1999 Takagi
6,082,852 A 7/2000 Soga
6,460,984 B1 * 10/2002 Matsumoto et al. ..... 347/86
6,536,861 B1 * 3/2003 Usui et al. ..... 347/86
6,722,762 B2 4/2004 Miyazawa

FOREIGN PATENT DOCUMENTS

| | | |
|---|---|---|
| JP | 08-216424 | 8/1996 |
| JP | 09-300646 | 11/1997 |
| JP | 2003-080730 | 3/2003 |
| JP | 2005-067075 | 3/2005 |

* cited by examiner

*Primary Examiner*—Julian D Huffman
(74) *Attorney, Agent, or Firm*—Canon USA Inc IP Div

(57) ABSTRACT

A liquid container includes a housing, a flexible film, a liquid reservoir configured to directly store liquid therein and defined by the housing on one side and the flexible film on the other side, a liquid supply port provided in the liquid reservoir and configured to supply liquid to a recording head, and an overhang protruding from the housing and located in the liquid reservoir and substantially near the liquid supply port. The absorbing member is configured to absorb the inertial force of liquid, the inertial force being generated in liquid in the liquid reservoir by an external force applied to the housing.

15 Claims, 11 Drawing Sheets

LIQUID CONTAINER

BACKGROUND OF THE INVENTION

1. Field of the Invention

The present invention relates to liquid containers and particularly to a liquid container for supplying ink to an inkjet recording head of an inkjet recording apparatus.

2. Description of the Related Art

Replaceable ink tanks are conventionally used as ink tanks for inkjet printers. Such a replaceable ink tank has a problem in that while the tank is being replaced, ink leaks out of the tank toward a joint where the tank is attached to the printer and, for example, makes the user's hands dirty or drips onto the printer main body.

FIG. 16 illustrates an exemplary configuration of an ink tank disclosed in Japanese Patent Laid-Open No. 09-300646 (corresponding to U.S. Pat. No. 6,082,852). An ink tank T2000 includes a main ink reservoir T2003 and an intermediary reservoir T2006 under the main ink reservoir T2003. A capillary member T2004 inside the main ink reservoir T2003 holds ink and maintains a negative pressure therein. The intermediary reservoir T2006 is provided with an ink supply port T2002 at the bottom to which a recording head is to be connected. The ink supply port T2002 is provided with a meniscus forming member (filter) T2009.

FIG. 17 is a cross-sectional view illustrating an exemplary configuration of an ink tank for pigment ink disclosed in Japanese Patent Laid-Open No. 2003-080730 (corresponding to U.S. Pat. No. 6,722,762).

To ensure a uniform concentration of ink inside the tank where a concentration gradient often occurs, an ink reservoir T2001, an ink channel T2014, and an ink supply port T2002 of the ink tank are arranged to form a complex structure. The ink supply port T2002 is provided with a ball valve, with which the ink reservoir T2001 is closed.

FIG. 18 illustrates an exemplary configuration of an ink tank disclosed in Japanese Patent Laid-Open No. 08-216424 (corresponding to U.S. Pat. No. 6,000,790). Unlike the intermediary reservoir T2006 illustrated in FIG. 16, an intermediary reservoir T2006 in FIG. 18 has the form of a narrow channel and is provided with an ink supply port T2002 at an end thereof.

FIG. 19 illustrates an exemplary configuration of an ink tank disclosed in Japanese Patent Laid-Open No. 2005-067075. An intermediary reservoir T2006 having the form of a narrow channel is provided with an ink supply port T2002 at a bottom end thereof. The intermediary reservoir T2006 communicates with a main ink reservoir T2003 through an opening T2014.

In the ink tank T2000 illustrated in FIG. 16, the intermediary reservoir T2006 filled with ink is disposed over the meniscus forming member T2009 for the ink supply port T2002. Therefore, external shocks applied to the ink tank T2000 when it is dropped may cause the ink inside the intermediary reservoir T2006 to break a meniscus formed at the meniscus forming member T2009 and further, to spatter from inside the ink tank T2000 to the outside.

In the ink tank illustrated in FIG. 17, the ball valve for the ink supply port T2002 can prevent ink from spattering. However, the ink tank, which is closed with the ball valve, suffers the disadvantages of having a complicated structure and the reduced amount of ink that can be stored in the ink tank.

Like the ink tank illustrated in FIG. 16, the ink tank in either FIG. 18 or FIG. 19 is configured such that the intermediary reservoir T2006, which is filled with ink, extends toward the ink supply port T2002. Therefore, if, for example, the ink tank T2000 is dropped and subjected to external shocks, the pressure of the ink may be easily and directly transmitted to the ink supply port T2002. This may cause a meniscus at the meniscus forming member to be broken and the ink to spatter.

SUMMARY OF THE INVENTION

The present invention is directed to a liquid container that does not cause ink to easily spatter even when the container is dropped or subjected to force or shocks. The present invention is also directed to a cartridge and recording apparatus incorporating the liquid container.

According to an aspect of the present invention, a liquid container includes a housing; a flexible film; a liquid reservoir configured to directly store liquid therein, the housing defining one side of the liquid reservoir and the flexible film defining another side of the liquid reservoir; a liquid supply port provided in the liquid reservoir and configured to supply liquid to a recording head; and a first overhang protruding from the housing, and located in the liquid reservoir and substantially near the liquid supply port.

In one embodiment of the present invention, the first overhang includes an absorbing member configured to absorb the inertial force of liquid being generated in liquid in the liquid reservoir by an external force applied to the housing and being directed to the liquid supply port.

According to another embodiment of the present invention, the first overhang may be located in the liquid reservoir and opposite the liquid supply port, and configured to hide the liquid supply port when viewed from the liquid reservoir.

According to another embodiment of the present invention, the liquid container may further include a second overhang located adjacent to the first overhang and configured to surround the liquid supply port.

According to another embodiment of the present invention, the first overhang includes at least one adjacent channel, and a liquid communication path may be formed between the liquid supply port and the liquid reservoir by the flexible film and the channel that are in contact with each other.

According to another embodiment of the present invention, the first overhang includes at least one channel, and a liquid communication path may be formed between the liquid supply port and the liquid reservoir by the flexible film and the channel that are in contact with each other.

According to another embodiment of the present invention, the flexible film may be arranged to be in contact with the first overhang and the second overhang, and includes a third overhang that is adjacent to the liquid supply port and is configured to absorb the inertial force of liquid, the inertial force being generated in liquid in the liquid reservoir by an external force applied to the housing.

According to another embodiment of the present invention, the liquid supply port includes a meniscus forming member, or a capillary force generating member in fabric form on the side to which the recording head is to be connected.

According to another embodiment of the present invention, a liquid container includes a housing; a liquid reservoir configured to directly store liquid therein, the liquid reservoir being located in the housing; a liquid supply port provided in the liquid reservoir and configured to supply liquid to a recording head; and an overhang protruding from the housing, and located in the liquid reservoir so as to absorb the inertial force of liquid being generated in liquid in the liquid reservoir by an external force applied to the housing and being directed to the liquid supply port.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

First Exemplary Embodiment

First, an inkjet recording apparatus on which a liquid container of the present invention is mounted will be described.

An inkjet recording apparatus is a non-impact recording apparatus capable of recording at high speed, with little noise, and on various types of recording media. The inkjet recording apparatus is widely used as a device capable of performing the recording functions of printers, word processors, facsimiles, and copiers.

Figure 14:
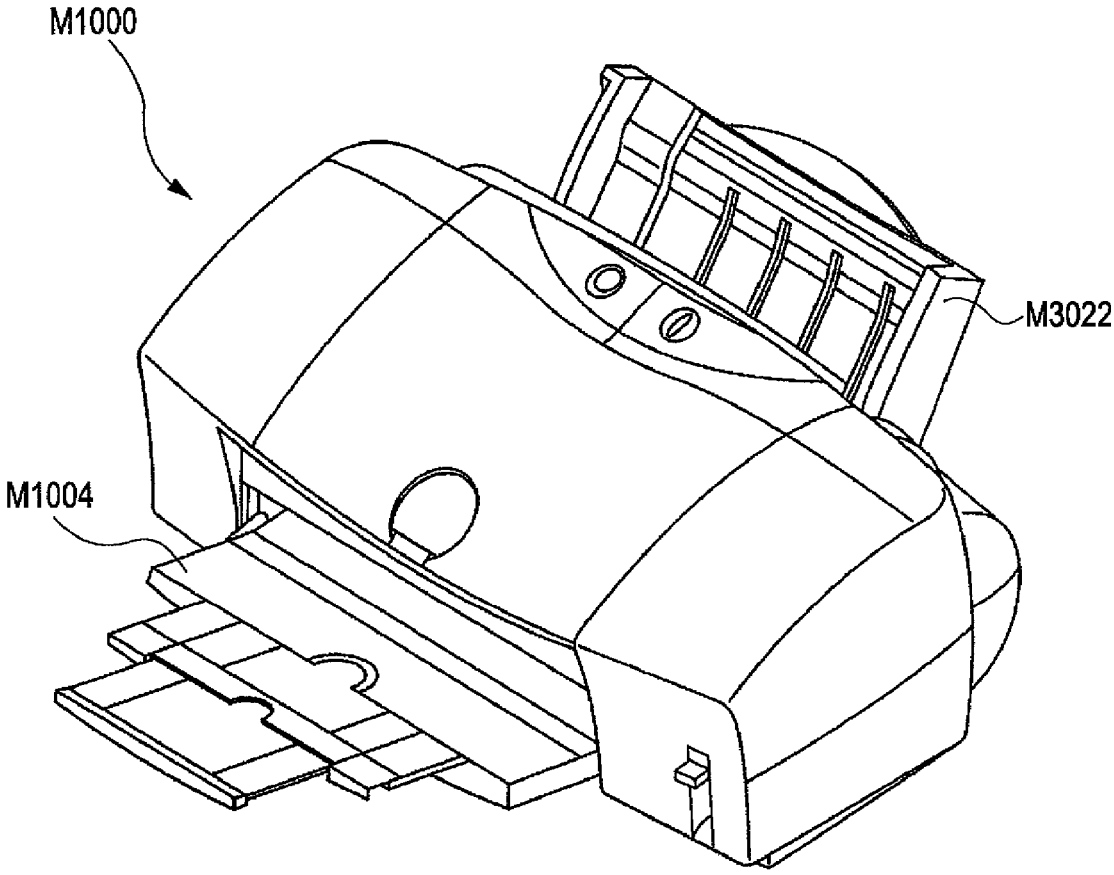
FIG. 14 is a perspective view illustrating an exemplary inkjet recording apparatus on which a liquid container of the present invention is mounted.

FIG. 14 illustrates a basic configuration of an inkjet recording apparatus. As illustrated, the inkjet recording apparatus includes a main body M1000, a feeder M3022 for feeding recording media such as paper, and an ejection tray M1004.

Figure 15:
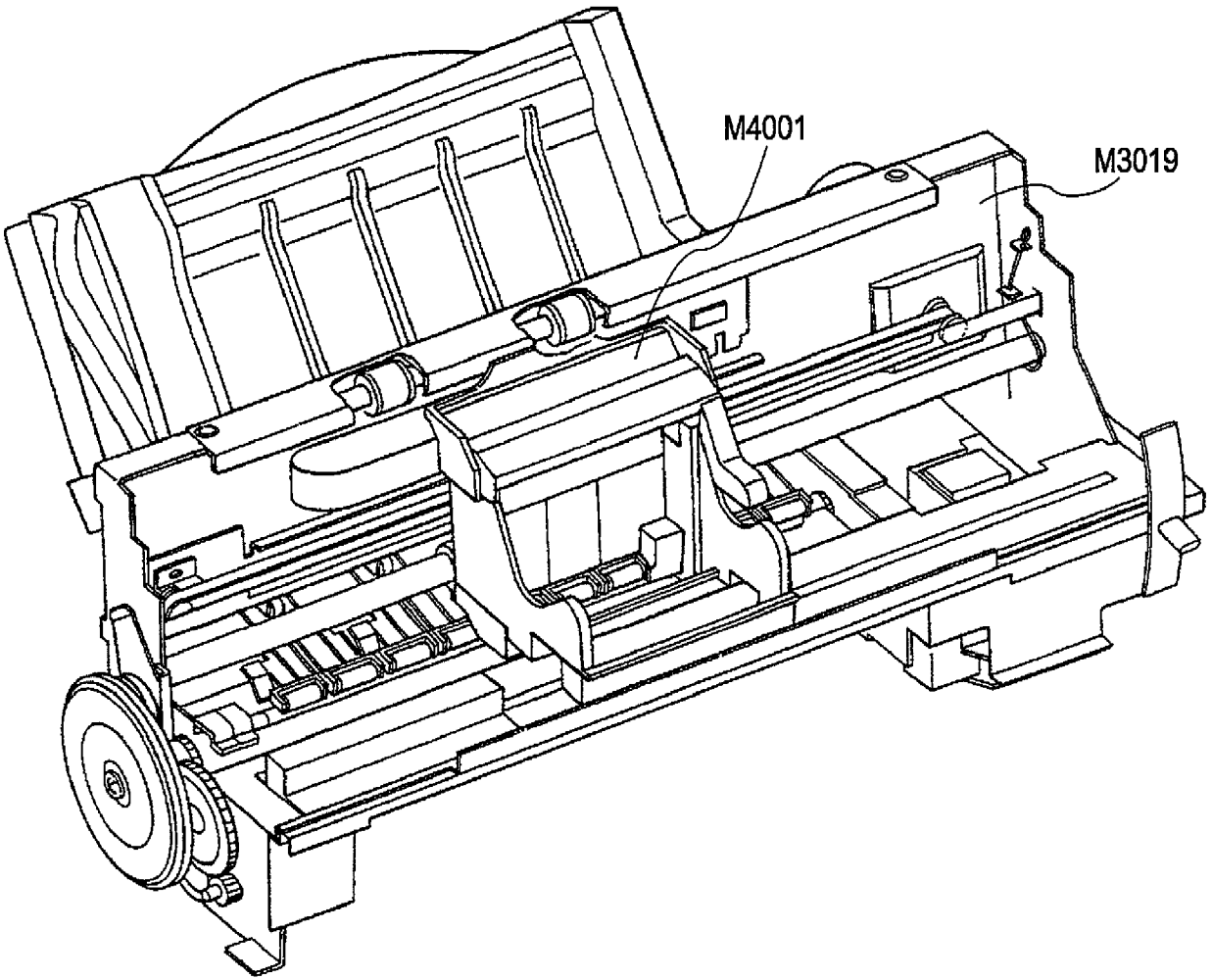
FIG. 15 is a perspective view illustrating an exemplary internal configuration of the inkjet recording apparatus in FIG. 14.
Figure 16:
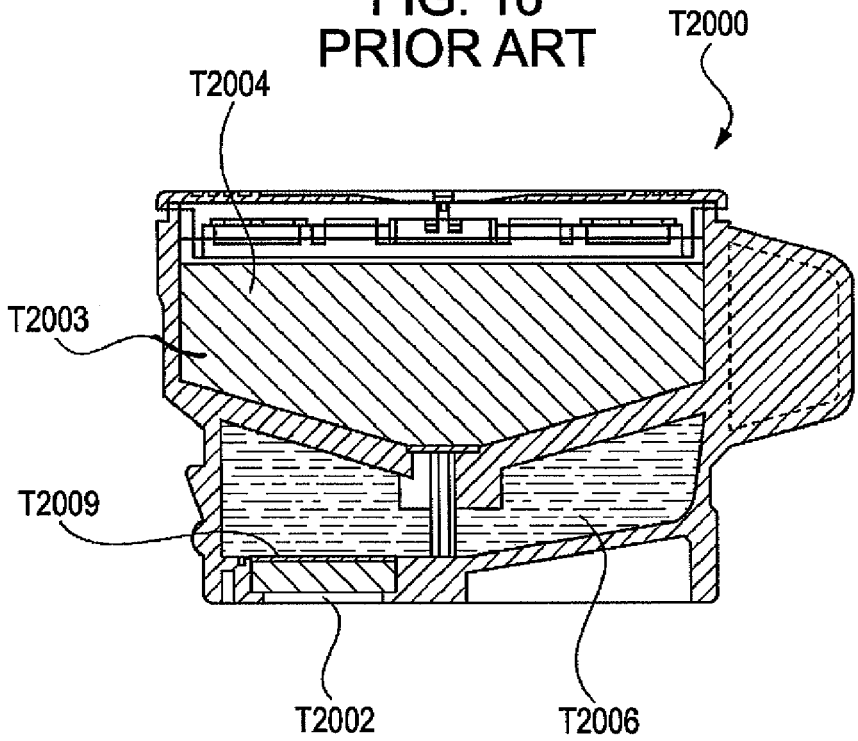
FIG. 16 PRIOR ART
FIG. 16 illustrates an exemplary configuration of a known ink tank.
Figure 17:
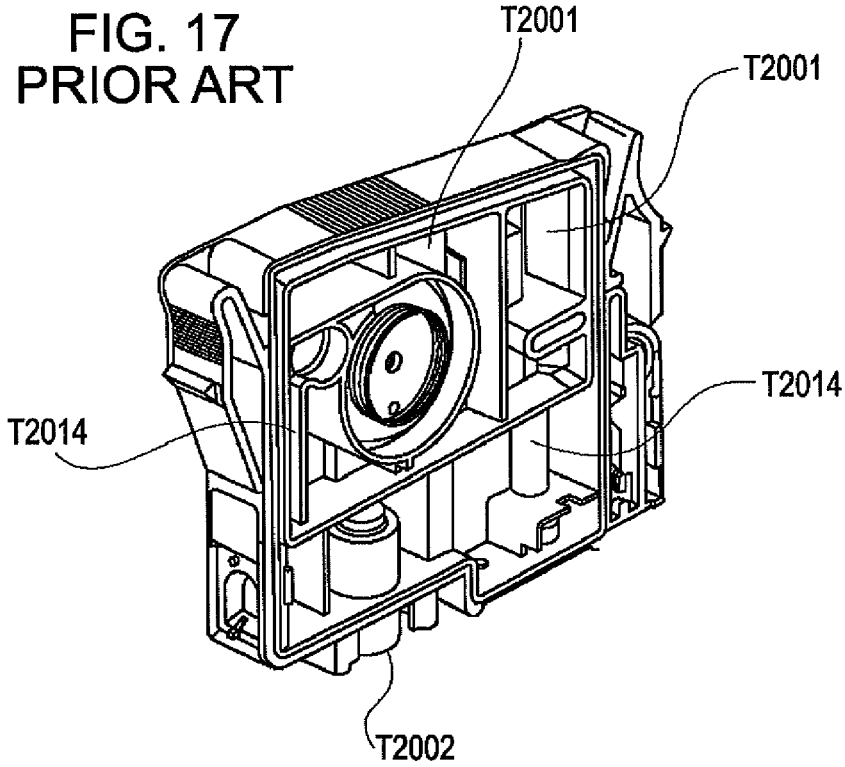
FIG. 17 PRIOR ART
FIG. 17 illustrates an exemplary configuration of another known ink tank.
Figure 18:
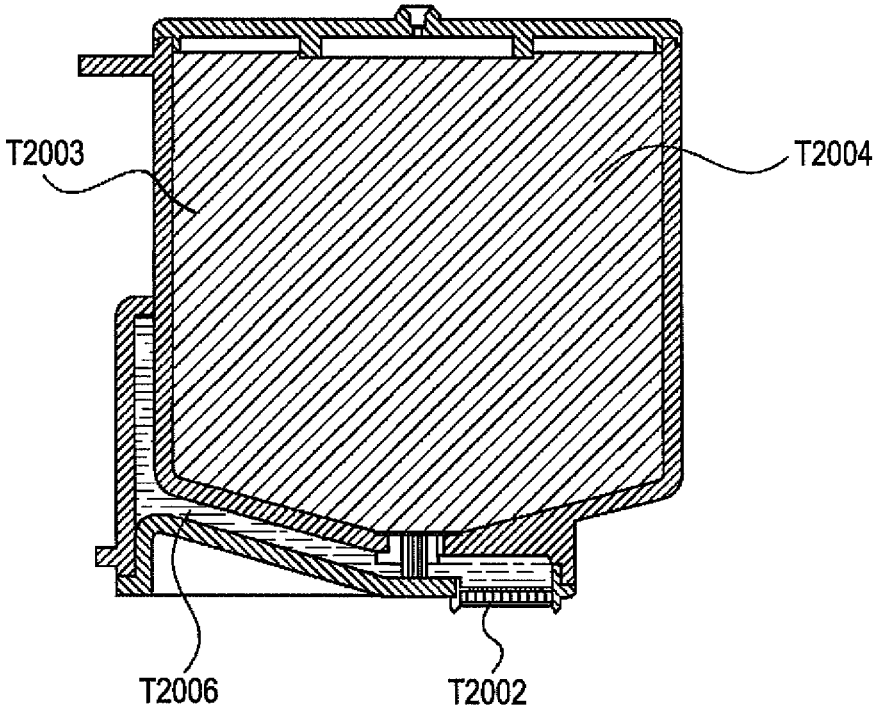
FIG. 18 PRIOR ART
FIG. 18 illustrates an exemplary configuration of another known ink tank.
Figure 19:
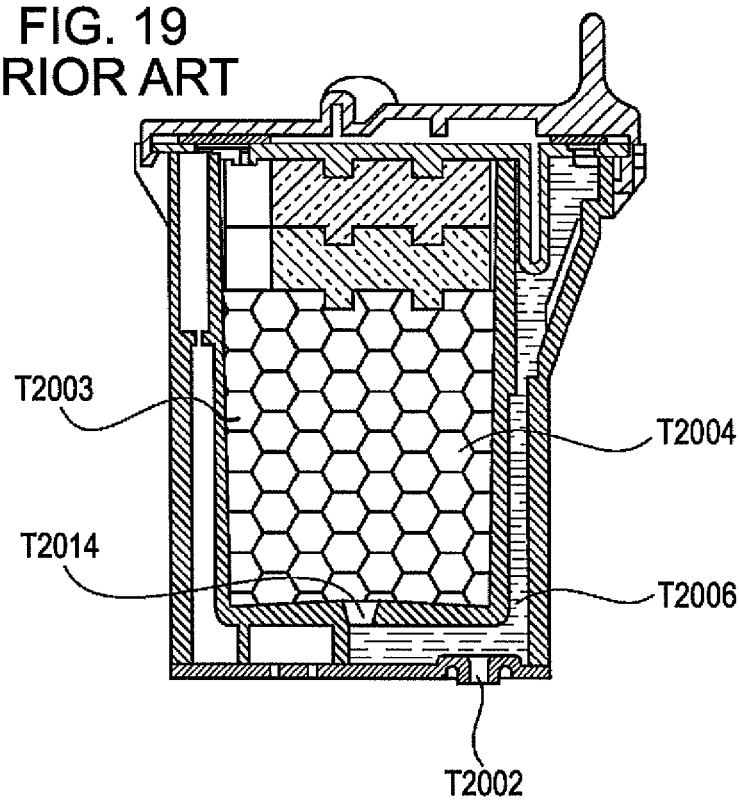
FIG. 19 PRIOR ART
FIG. 19 illustrates an exemplary configuration of another known ink tank.

FIG. 15 illustrates an internal configuration of the inkjet recording apparatus in FIG. 14. As illustrated, the inkjet recording apparatus includes a chassis M3019 and other components for recording operations. A recording head cartridge (not shown) for performing recording, as intended, on a recording sheet conveyed to a recording position is removably mounted on a carriage M4001. The recording head cartridge includes a recording head for ejecting liquid, and an ink tank removably attached to the recording head. The recording head is configured to heat ink with an electrothermal transducer having a heating element so as to allow ink droplets to be ejected from nozzles by film boiling.

(Overall Configuration)

Next, a general configuration of a liquid container of the present invention, the liquid container being mounted on the above-describe inkjet recording apparatus, will be described with reference to FIG. 1 to FIG. 5.

Figure 1:
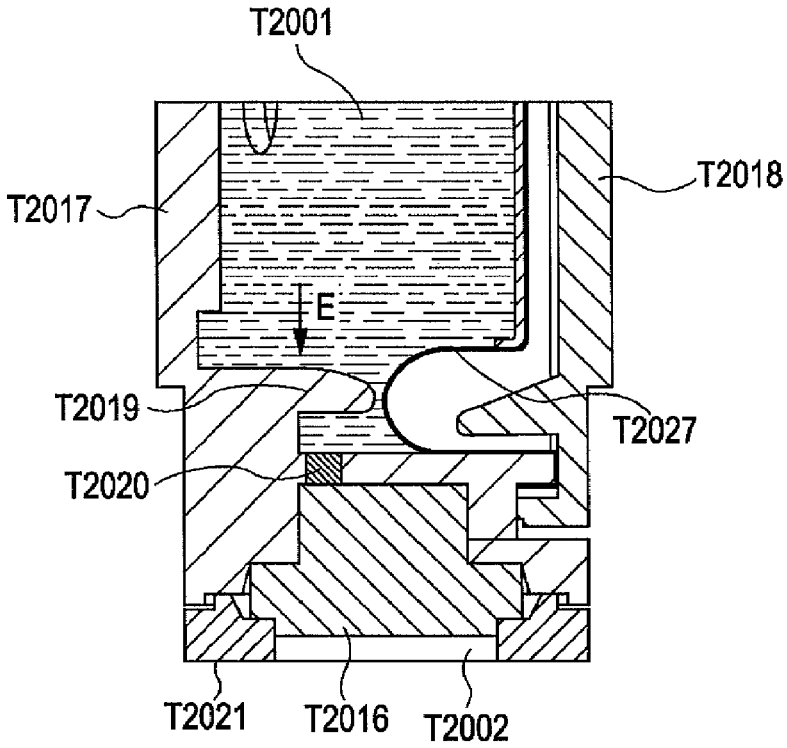
FIG. 1 is a cross-sectional view illustrating an exemplary liquid container according to a first exemplary embodiment of the present invention.
Figure 2:
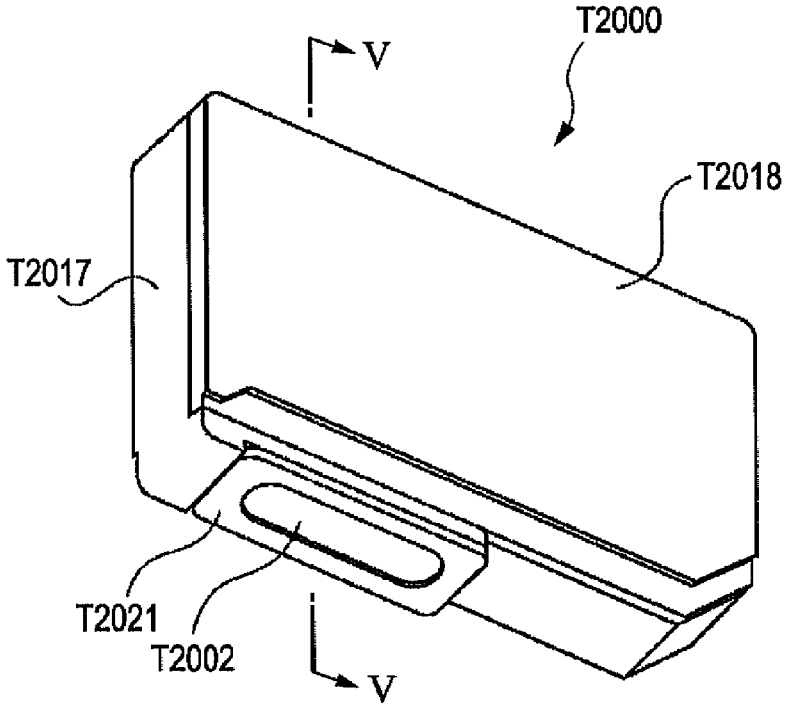
FIG. 2 is an external perspective view of the liquid container illustrated in FIG. 1.
Figure 3:
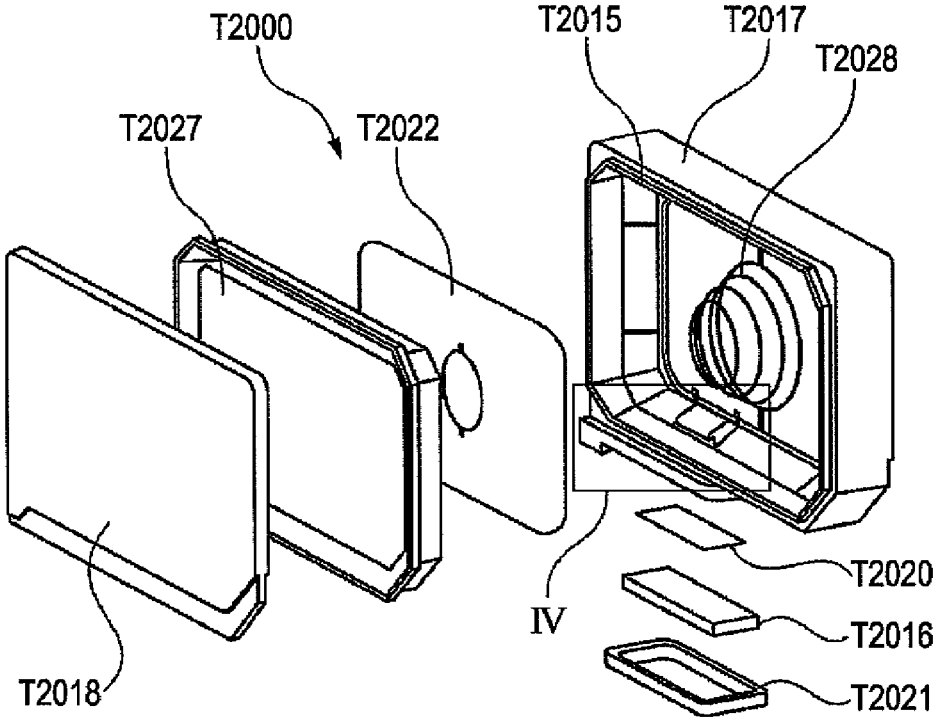
FIG. 3 is an exploded perspective view of the liquid container illustrated in FIG. 2.
Figure 4:
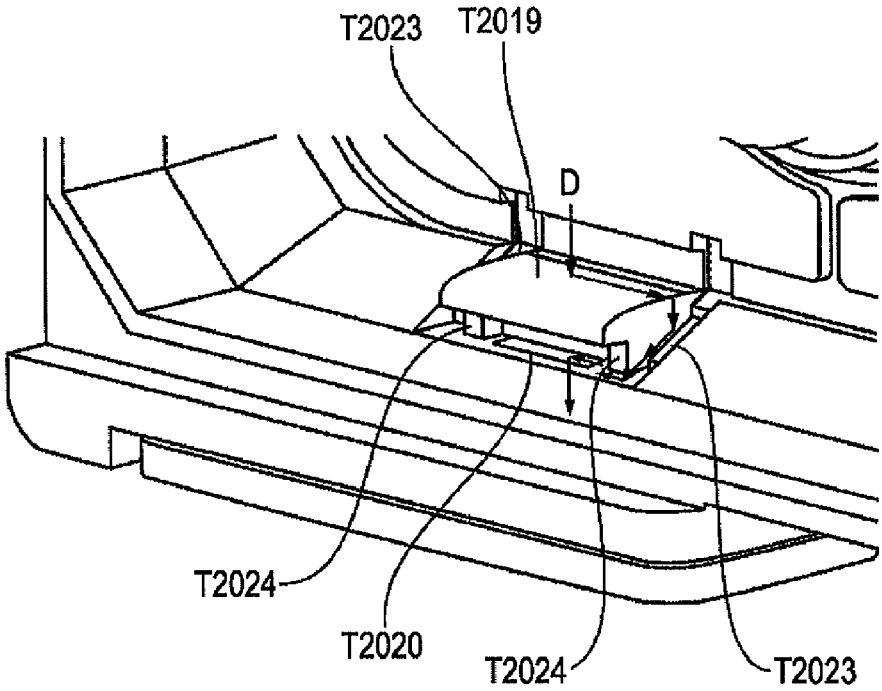
FIG. 4 is an enlarged view of section "IV" in FIG. 3.
Figure 5:
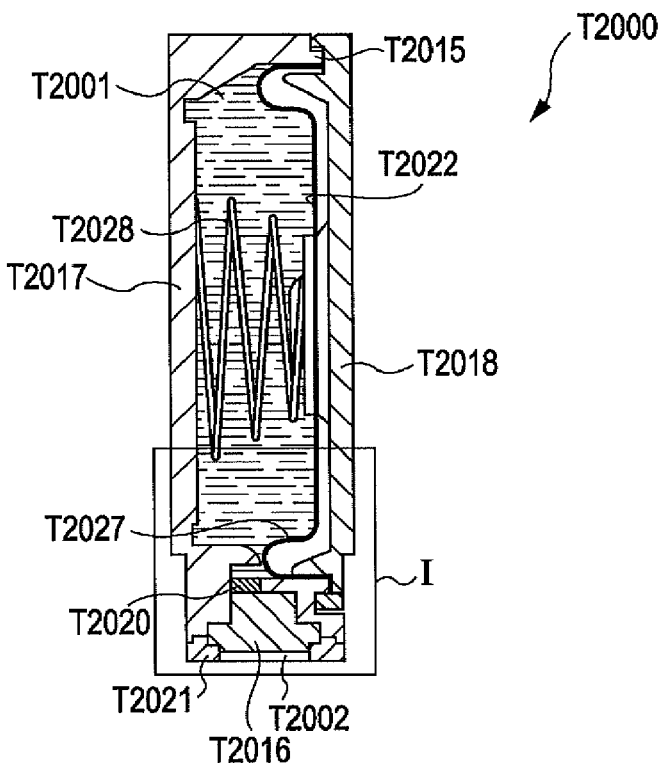
FIG. 5 is a cross-sectional view taken along line V-V in FIG. 2.

FIG. 1 illustrates an ink tank according to the first exemplary embodiment of the present invention. FIG. 1 is an enlarged view of section "I" in FIG. 5, which illustrates the ink tank in which a negative pressure is generated by a spring. FIG. 2 is an external perspective view of the ink tank illustrated in FIG. 1. FIG. 3 is an exploded perspective view of the ink tank illustrated in FIG. 2. FIG. 4 is an enlarged view of section "IV" in FIG. 3. FIG. 5 is a cross-sectional view taken along line V-V in FIG. 2.

An ink tank T2000 is a liquid container for storing ink. As illustrated in FIG. 2, a housing T2017 and a lid T2018 constitute the exterior of the ink tank T2000, which is internally provided with an ink reservoir. The ink tank T2000 is provided with an ink supply port T2002, at the bottom thereof, for supplying ink to a recording head (not shown).

As illustrated in FIG. 3, the ink tank T2000 includes the housing T2017, a spring T2028, a plate member T2022, a flexible film T2027, the lid T2018, a meniscus forming member T2020, an ink inducing member T2016, and a retainer T2021.

The housing T2017 can be made of polypropylene. As illustrated in FIG. 3 and FIG. 5, at the point where the ink supply port (T2002) communicates with the main body of the ink tank T2000, the meniscus forming member T2020, the ink inducing member T2016, and the retainer T2021 are attached to the housing T2017 in this order.

The meniscus forming member T2020 of the present exemplary embodiment can be a stainless mesh filter with a pore diameter of about 15 to 30 μm. The meniscus forming member T2020 forms an ink meniscus to prevent bubbles from entering an ink reservoir T2001 (described below). The meniscus forming member T2020 is not limited to the mesh filter described above, but may be a high-density felt fabric or the like that can achieve similar effects.

The ink inducing member T2016 of the present exemplary embodiment can be a capillary member having a capillary force and made of polypropylene fabric.

The flexible film T2027 is welded to an opening frame T2015 of the housing T2017 so as to form the ink reservoir T2001, in which ink is contained. The flexible film T2027 can be a film member which has a thickness of about 20 to 100 μm and includes a polypropylene thin film.

In the ink reservoir T2001, the spring T2028 biases the flexible film T2027 toward the outside of the ink tank T2000, with the plate member T2022 interposed between the spring T2028 and the flexible film T2027, so as to generate a negative pressure in the ink tank T2000. The spring T2028 and the plate member T2022 can be made of a stainless material. The lid T2018 is attached to the main body of the ink tank T2000 at the opening thereof so as to protect the flexible film T2027, which has been bent into a convex shape toward the outside of the ink tank T2000.

In the configuration described above, as ink in the ink reservoir T2001 is consumed by being supplied to the recording head, the spring T2028 shrinks, the flexible film T2027 bends, and the capacity of the ink reservoir T2001 gradually decreases.

(Configuration of Ink Supply Section)

FIG. 1 and FIG. 4 are an enlarged cross-sectional view and an enlarged perspective view, respectively, of an ink supply section of the ink tank T2000. The ink tank T2000 of the first exemplary embodiment is provided with an obstacle T2019 that is located opposite the meniscus forming member T2020 at the bottom of the ink reservoir T2001. The obstacle T2019 absorbs the inertial force of ink, the inertial force being generated by external shocks to the ink tank T2000. In the present exemplary embodiment, the obstacle T2019 is formed in the shape of an overhang protruding from the inner wall of the main body of the ink tank T2000. The obstacle T2019 is positioned such that the meniscus forming member T2020 is hidden behind the obstacle T2019 when viewed in the direction of arrow "E" in FIG. 1. In the present exemplary embodiment, the distance between the obstacle T2019 and the meniscus forming member T2020 is about 0.5 to 1.5 mm (which is normally expected to be smaller) in view of the dimensions of molds for plastic molding. Additionally, there are channel-like alternative paths T2023 adjacent to the obstacle T2019. The alternative paths T2023 are partially formed in a direction different from that of the meniscus forming member T2020, and then bent to communicate with the meniscus forming member T2020. The obstacle T2019 and the flexible film T2027 are configured to surround the meniscus forming member T2020.

(Operation)

FIG. 5 is a cross-sectional view taken along line V-V in FIG. 2 and illustrates the position of the ink supply port T2002 in the overall view of the ink tank T2000.

Since the obstacle T2019 in the ink reservoir T2001 is located near the meniscus forming member T2020 in the ink supply section, the inertial force of ink toward the meniscus forming member T2020 can be reduced when the ink tank T2000 is subjected to force or shocks.

In other words, the obstacle T2019 prevents the inertial force of ink attempting to move through the ink reservoir T2001 from easily being transmitted directly to the meniscus forming member T2020. Moreover, as indicated by arrow "D" in FIG. 4, the obstacle T2019 diverts the flow of ink to the alternative paths T2023. This can prevent the ink from easily spattering from the ink supply port T2002. After flowing through the alternative paths T2023, the ink passes through the meniscus forming member T2020 and is supplied via the ink supply port T2002 to the recording head.

As illustrated in FIG. 4, second obstacles T2024 may also be provided, at curves of the alternative paths T2023, so as to surround the meniscus forming member T2020. This allows the inertial force of ink to be reduced even when the ink tank T2000 is dropped at an angle. The inertial force of ink is the flowing force of ink trying to move from an ink reservoir toward an ink supply port.

Moreover, part of the flexible film T2027, which is located to surround the meniscus forming member T2020, serves as a third obstacle.

By using the simple configuration described above, it is possible to provide an ink tank that is capable of preventing ink from easily spattering from the ink supply port even when the ink tank is accidentally dropped by the user or is subjected to force or shocks.

Second Exemplary Embodiment

Figure 6:
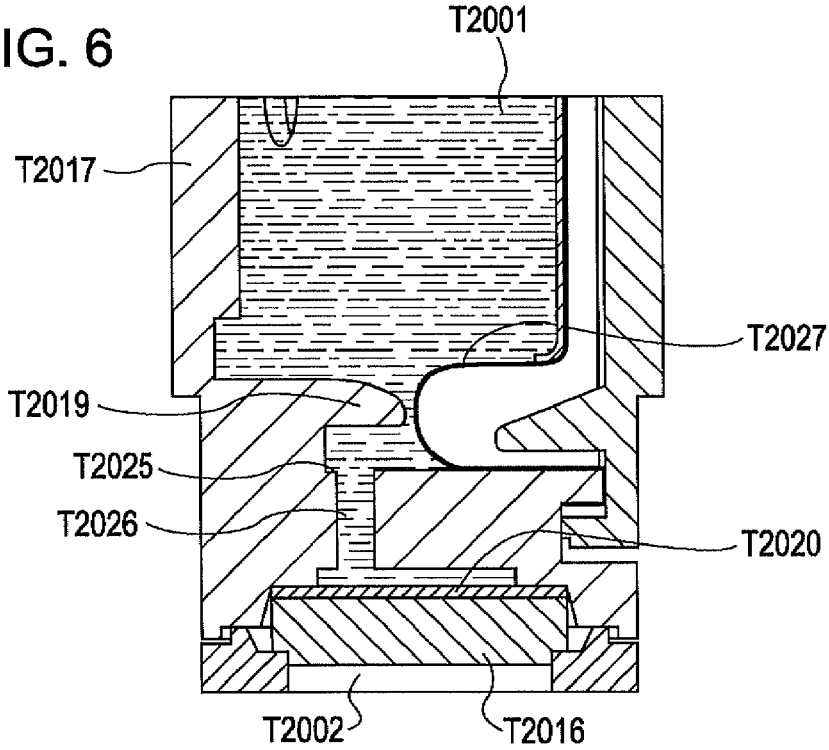
FIG. 6 is a cross-sectional view illustrating an exemplary liquid container according to a second exemplary embodiment of the present invention.
Figure 7:
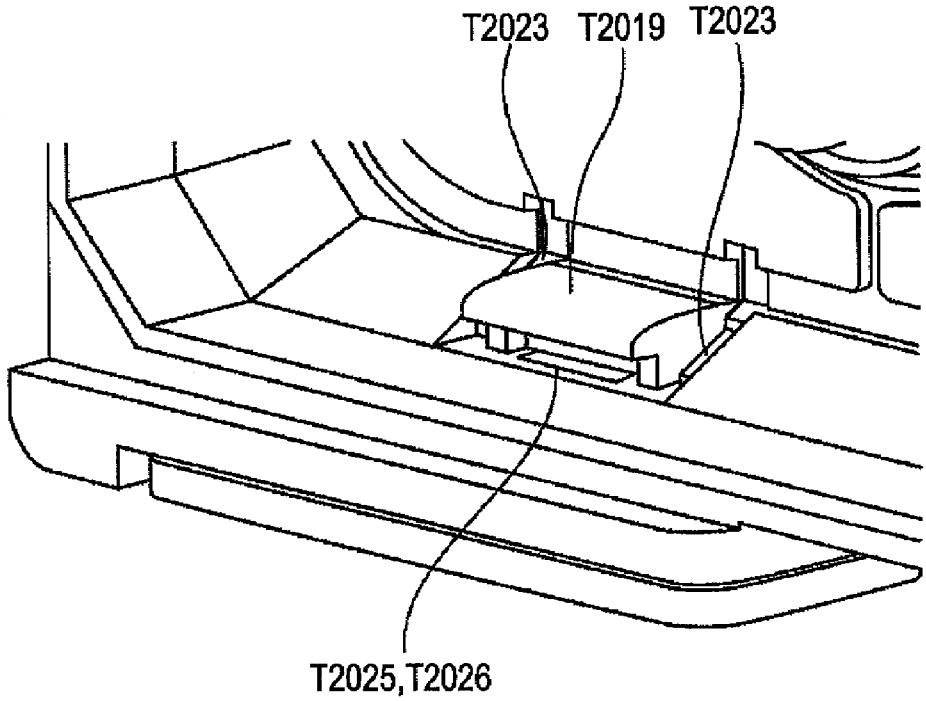
FIG. 7 is a perspective view illustrating an exemplary internal configuration of the liquid container in FIG. 6.

FIG. 6 is a cross-sectional view illustrating an exemplary ink tank according to the second exemplary embodiment of the present invention. FIG. 7 is a perspective view illustrating an exemplary internal configuration of the ink tank in FIG. 6.

The ink tank of the second exemplary embodiment has basically the same configuration as that of the first exemplary embodiment except that an ink channel T2026 is provided between an ink reservoir T2001 for storing ink and a meniscus forming member T2020 for an ink supply port T2002.

The ink channel T2026 has an opening T2025 at the bottom of the ink reservoir T2001. The ink tank of the present exemplary embodiment is provided with an obstacle T2019 that is located near and opposite the opening T2025. When the ink tank is subjected to external shocks, the obstacle T2019 absorbs the inertial force of ink, the inertial force being generated by the external shocks. After flowing through alternative paths T2023, the ink passes through the ink channel T2026 and is supplied via the ink supply port T2002 to the recording head.

In the ink tank configured as described above, the obstacle T2019 in the ink reservoir T2001 is located near the opening T2025 of the ink channel T2026 which communicates with the ink supply section. This has the effect of reducing the inertial force of ink toward the ink supply port T2002, the inertial force being generated by external force or shocks applied to the ink tank. The ink tank capable of preventing ink from easily spattering can thus be achieved.

Third Exemplary Embodiment

Figure 8:
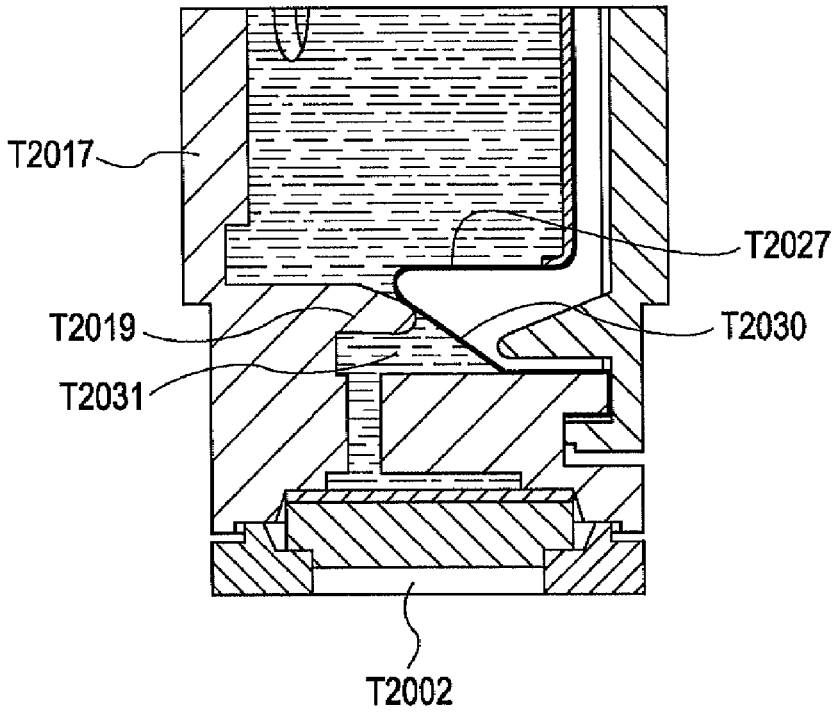
FIG. 8 is a cross-sectional view illustrating an exemplary liquid container according to a third exemplary embodiment of the present invention.
Figure 9:
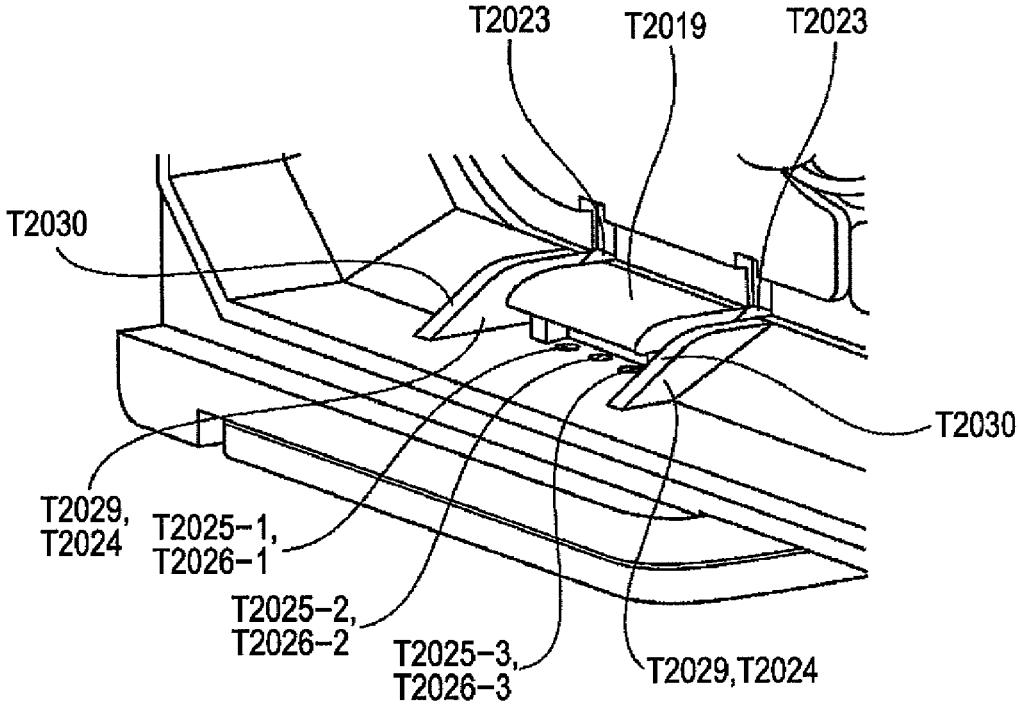
FIG. 9 is a perspective view illustrating an exemplary internal configuration of the liquid container in FIG. 8.

FIG. 8 is a cross-sectional view illustrating an exemplary ink tank according to the third exemplary embodiment of the present invention. FIG. 9 is a perspective view illustrating an exemplary internal configuration of the ink tank in FIG. 8.

In the ink tank of the present exemplary embodiment, an obstacle T2019 and sidewalls T2029 of respective channel-like alternative paths T2023 are substantially equal in height. The alternative paths T2023 are provided on respective sides of the obstacle T2019.

In the ink tank with this configuration, a large cross-sectional area of the alternative paths T2023 can be secured. At the same time, the sidewalls T2029 can serve as second obstacles T2024 that surround an opening T2025 of an ink channel T2026.

Therefore, it is possible to reduce not only the inertial force of ink directed linearly from an ink reservoir to an ink supply port T2002, but also that applied from either side of the obstacle T2019. The effect of preventing ink from easily spattering can thus be achieved.

Additionally, slopes T2030 are provided at points where the sidewalls T2029 are in contact with a flexible film T2027. As described above, the obstacle T2019 and the sidewalls T2029 are substantially equal in height. This configuration facilitates the contact of the flexible film T2027 with the sidewalls T2029 and obstacle T2019, and further enhances the function of the sidewalls T2029 as the second obstacles T2024.

As illustrated in FIG. 8, the flexible film T2027 extends from an end of the obstacle T2019 along the slopes T2030 and covers a small chamber T2031 defined by the ink reservoir, the obstacle T2019, and the second obstacles T2024. With respect to the small chamber T2031, the area of the opening T2025 of the ink channel T2026 may be reduced, or the ink channel T2026 may be divided into sub-channels.

This configuration creates resistance to the flow of ink, reduces the inertial force of ink generated by the external shocks, and thus can prevent ink from easily spattering. In the present exemplary embodiment, the ink channel T2026 is divided into three sub-channels T2025-1, T2025-2, and T2025-3 (or T2026-1, T2026-2, and T2026-3).

Fourth Exemplary Embodiment

Figure 10:
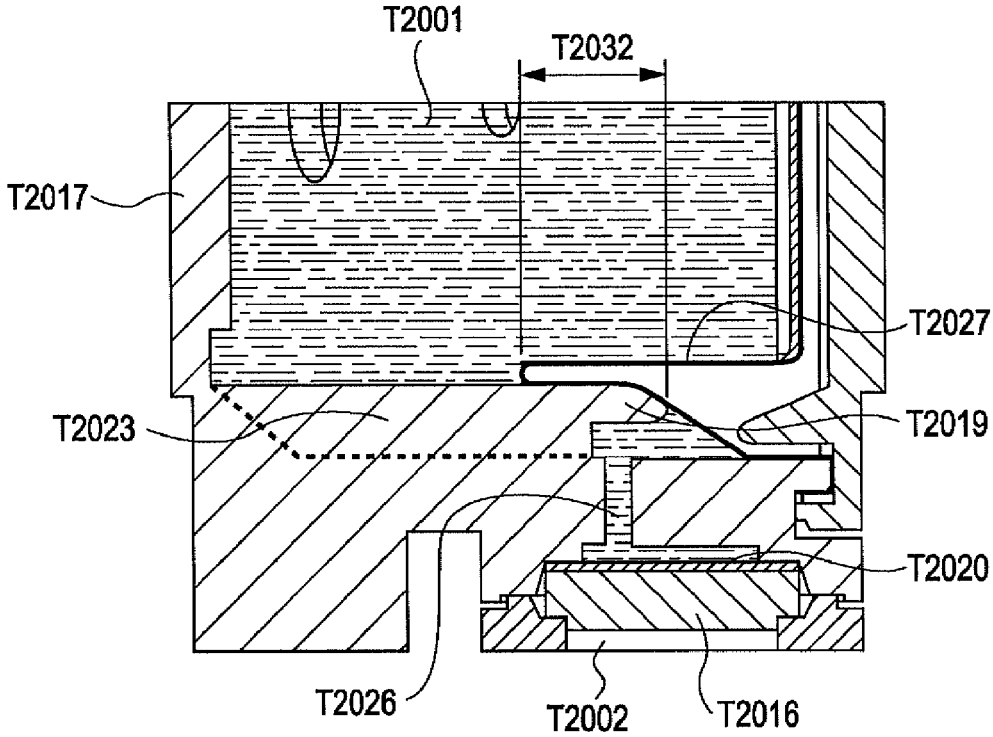
FIG. 10 is a cross-sectional view illustrating an exemplary liquid container according to a fourth exemplary embodiment of the present invention.
Figure 11:
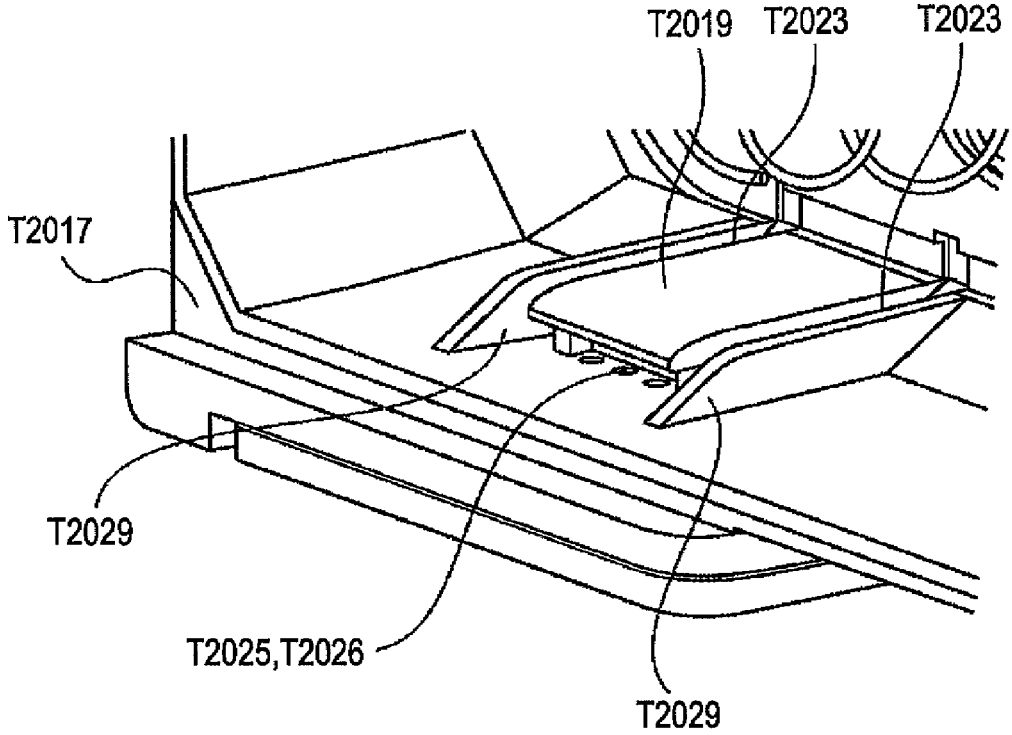
FIG. 11 is a perspective view illustrating an exemplary internal configuration of the liquid container in FIG. 10.

FIG. 10 is a cross-sectional view illustrating an exemplary ink tank according to the fourth exemplary embodiment of the present invention. FIG. 11 is a perspective view illustrating an exemplary internal configuration of the ink tank in FIG. 10.

As illustrated in FIG. 10 and FIG. 11, in the ink tank of the present exemplary embodiment, an ink supply port T2002, an ink inducing member T2016, a meniscus forming member T2020, an ink channel T2026, and an obstacle T2019 are provided on the opening side of a housing T2017. Specifically, as indicated by arrow T2032 in FIG. 10, a portion of the obstacle T2019 at the bottom of an ink reservoir T2001, the portion extending from an end to the upper part of the obstacle T2019, is covered with a flexible film T2027.

In the ink tank with this configuration, part of alternative paths T2023, as well as the obstacle T2019, is consistently covered with the flexible film T2027, which constitutes a part of the ink reservoir T2001. Specifically, a dotted line in FIG. 10 represents the bottom surface of one of the alternative paths T2023 in the housing T2017 and indicates that the upper side of the alternative path T2023 is partially covered with the flexible film T2027.

The flexible film T2027, which covers the alternative paths T2023, can thus further reduce ink pressure generated by external force or shocks, and can regulate the flow of ink to ensure a reliable flow of ink along the alternative paths T2023. The effect of preventing ink from easily spattering from the ink supply port T2002 can thus be achieved.

Fifth Exemplary Embodiment

Figure 12:
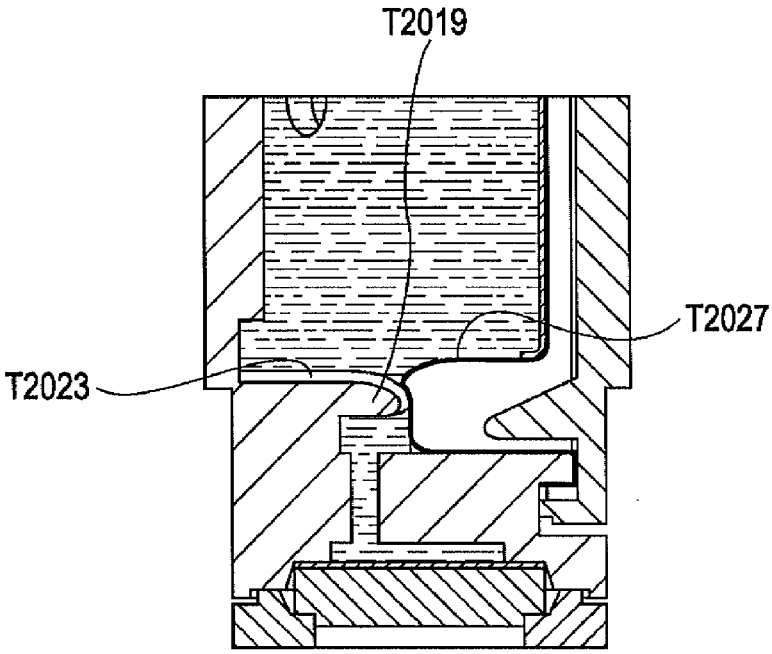
FIG. 12 is a cross-sectional view illustrating an exemplary liquid container according to a fifth exemplary embodiment of the present invention.
Figure 13:
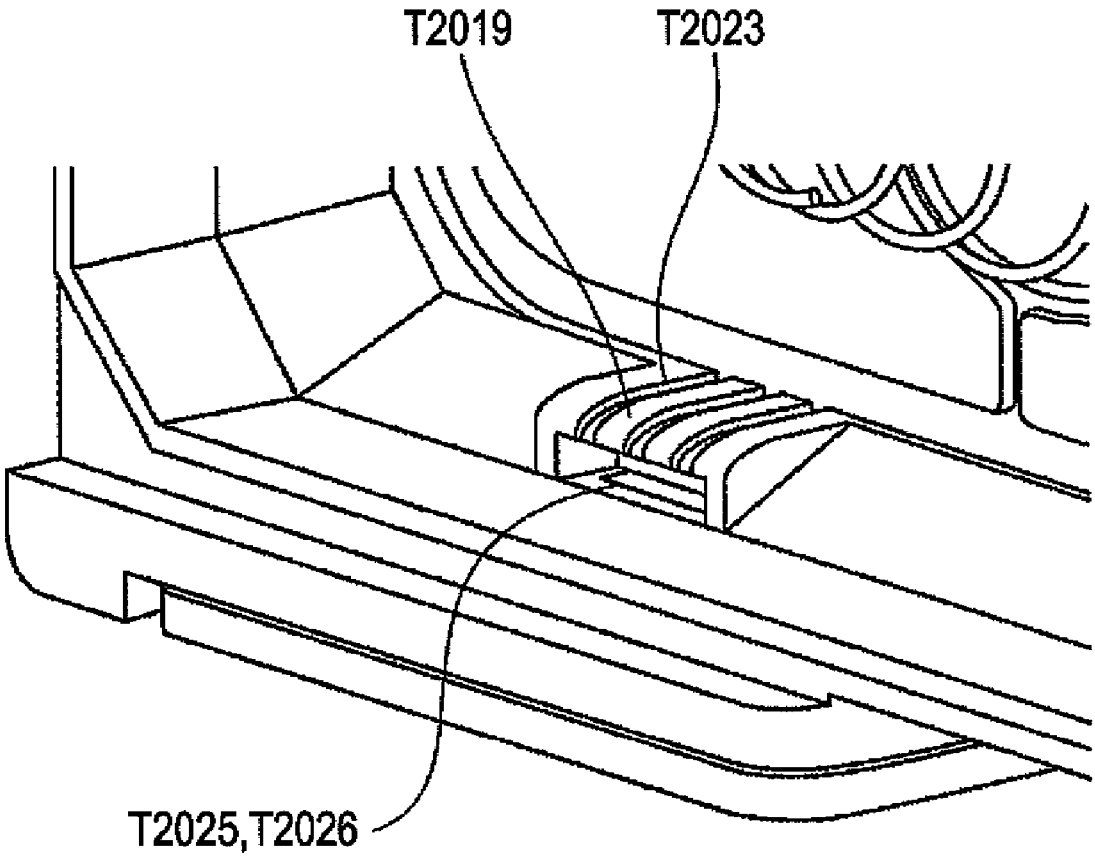
FIG. 13 is a perspective view illustrating an exemplary internal configuration of the liquid container in FIG. 12.

FIG. 12 is a cross-sectional view illustrating an exemplary ink tank according to the fifth exemplary embodiment of the present invention. FIG. 13 is a perspective view illustrating an exemplary internal configuration of the ink tank in FIG. 12.

As illustrated in FIG. 12 and FIG. 13, in the ink tank of the present exemplary embodiment, channel-like alternative paths T2023 are provided on the upper surface of an obstacle T2019, which has the shape of an overhang and protrudes from inside a housing T2017.

Thus, the alternative paths T2023 can be created not only on respective sides of the obstacle T2019, but also in other areas near an ink supply port. Even if a flexible film T2027 bends to cover the obstacle T2019, an ink channel can be secured.

By using the configuration described above, it is possible to reduce ink pressure generated by external force or shocks, and to regulate the flow of ink to ensure a reliable flow of ink along the alternative paths T2023. The effect of preventing ink from easily spattering from the ink supply port T2002 can thus be achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-255092 filed Sep. 2, 2005, which is hereby incorporated by reference herein in its entirety.

What is claimed is:

1. A liquid container comprising:

a housing having an open surface and an opening;

a flexible film fixed over the opening frame of the housing;

a liquid reservoir configured to directly store liquid therein, the liquid reservoir being formed of the housing and the flexible film;

a liquid supply port provided in the liquid reservoir and configured to supply liquid to a recording head;

a meniscus forming member disposed in a communication path between the liquid reservoir and the liquid supply port; and a first protrusion protruding from the housing, the first protrusion is disposed such that the first protrusion and the meniscus forming member face each other, and the first protrusion covers the meniscus forming member.

2. The liquid container according to claim 1, wherein the first protrusion includes an absorbing member configured to absorb the inertial force of liquid being generated in liquid in the liquid reservoir by an external force applied to the housing and being directed to the liquid supply port.

3. The liquid container according to claim 1, wherein the first protrusion is located in the liquid reservoir, and is disposed such that the first protrusion and the liquid supply port face each other, and the first protrusion covers the liquid supply port.

4. The liquid container according to claim 1, further comprising a second protrusion located adjacent to the first protrusion and configured to surround the liquid supply port.

5. The liquid container according to claim 4, wherein the flexible film is arranged to be in contact with the first protrusion and the second protrusion, and includes a third protrusion that is adjacent to the liquid supply port and is configured to absorb the inertial force of liquid, the inertial force being generated in liquid in the liquid reservoir by an external force applied to the housing.

6. The liquid container according to claim 1, wherein the first protrusion includes at least one adjacent channel, and the flexible film is in contact with the channel to form a liquid communication path between the liquid supply port and the liquid reservoir.

7. The liquid container according to claim 1, wherein the first protrusion includes at least one channel, and the flexible film is in contact with the channel to form a liquid communication path between the liquid supply port and the liquid reservoir.

8. The liquid container according to claim 1, wherein the liquid supply port includes a capillary force generating member in fabric form on the side to which the recording head is to be connected.

9. The liquid container according to claim 1, wherein the liquid stored in the liquid reservoir is a pigment ink.

10. A cartridge comprising a recording head and the liquid container according to claim 1 attached to the recording head, the recording head configured to eject liquid stored in the liquid container.

11. A recording apparatus operable to record images on recording media, comprising:

the liquid container according to claim 1;

a recording head attached to the liquid container and configured to eject liquid stored in the liquid container onto the recording media so as to record images on the recording media; and a carriage movably supporting the liquid container and the recording head.

12. A liquid container comprising:

a housing, a surface of the housing being open;

a flexible film fixed over an opening frame of the housing;

a liquid reservoir configured to directly store liquid therein, the liquid reservoir being formed of the housing and the flexible film;

a liquid supply port provided in the liquid reservoir and configured to supply liquid to a recording head;

a meniscus forming member disposed in a communication path between the liquid reservoir and the liquid supply port; and a protrusion protruding from the housing, and located in the liquid reservoir so as to absorb the inertial force of liquid being generated in liquid in the liquid reservoir by an external force applied to the housing and being disposed such that the first protrusion and the meniscus forming member face each other, and the first protrusion covers the meniscus forming member.

13. The liquid container according to claim 12, wherein the protrusion is located in the liquid reservoir, and is disposed such that the first protrusion and the liquid supply port face each other, and the first protrusion covers the liquid supply port.

14. A recording apparatus operable to record images on recording media, comprising:

the liquid container according to claim 12;

a recording head attached to the liquid container and configured to eject liquid stored in the liquid container onto the recording media so as to record images on the recording media; and a carriage movable supporting the liquid container and the recording head.

15. The liquid container according to claim 12, wherein the liquid stored in the liquid reservoir is a pigment ink.

* * * * *